US008785802B2

(12) United States Patent
Shang

(10) Patent No.: US 8,785,802 B2
(45) Date of Patent: Jul. 22, 2014

(54) CIRCUIT-BREAKER POLE PART AND METHOD FOR PRODUCING SUCH A POLE PART

(71) Applicant: ABB Technology AG, Zurich (CH)

(72) Inventor: Wenkai Shang, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/741,784

(22) Filed: Jan. 15, 2013

(65) Prior Publication Data

US 2013/0126480 A1 May 23, 2013

Related U.S. Application Data

(63) Continuation of application No. PCT/EP2011/003538, filed on Jul. 15, 2011.

(30) Foreign Application Priority Data

Jul. 15, 2010 (EP) ..... 10007321

(51) Int. Cl.

| | |
|---|---|
| ***H01H 33/66*** | (2006.01) |
| ***H01H 33/53*** | (2006.01) |
| *H01H 33/662* | (2006.01) |
| *H01H 33/666* | (2006.01) |
| *H01H 9/02* | (2006.01) |
| *H01H 1/58* | (2006.01) |

(52) U.S. Cl.

CPC ..... *H01H 33/53* (2013.01); *H01H 2033/6623* (2013.01); *H01H 33/666* (2013.01); *H01H 33/66207* (2013.01); *H01H 33/6606* (2013.01); *H01H 2009/0285* (2013.01); *H01H 1/5822* (2013.01)

USPC ..... 218/120; 218/134

(58) Field of Classification Search

USPC ..... 218/118–120, 134

See application file for complete search history.

(56) References Cited

U.S. PATENT DOCUMENTS 5,698,831 A 12/1997 Abdelgawad et al.
5,729,888 A 3/1998 Abdelgawad et al.

(Continued)

FOREIGN PATENT DOCUMENTS

DE 199 10 326 A1 9/2000
DE 10 2004 060274 A1 6/2006

(Continued)

OTHER PUBLICATIONS

International Search Report (PCT/ISA/210) issued on Oct. 18, 2011, by the European Patent Office as the International Searching Authority for International Application No. PCT/EP2011/003538.

(Continued)

*Primary Examiner* — Truc Nguyen

(74) *Attorney, Agent, or Firm* — Buchanan Ingersoll & Rooney PC

(57) ABSTRACT

Exemplary embodiments are directed to a method for producing a circuit-breaker pole part that includes an external insulating sleeve made of a solid synthetic material for supporting and housing a vacuum interrupter insert for electrical switching a medium-voltage circuit. An adhesive material layer at least on the lateral area of the interrupter insert is applied and the coated interrupter is embedded by molding with the solid synthetic material in order to form a single layer of the surrounding external insulating sleeve.

14 Claims, 2 Drawing Sheets

(56) References Cited

U.S. PATENT DOCUMENTS

| | | | | |
|---|---|---|---|---|
| 5,912,604 | A * | 6/1999 | Harvey et al. | 335/9 |
| 6,747,234 | B2 * | 6/2004 | Traska et al. | 218/134 |
| 7,843,293 | B1 | 11/2010 | Bonjean et al. | |
| 7,866,031 | B2 * | 1/2011 | Stoving et al. | 29/622 |
| 2005/0016963 | A1 * | 1/2005 | Stoving et al. | 218/120 |
| 2008/0041825 | A1 * | 2/2008 | Stoving et al. | 218/120 |
| 2008/0087647 | A1 * | 4/2008 | Volkmar | 218/134 |
| 2008/0142485 | A1 * | 6/2008 | Gentsch et al. | 218/118 |
| 2009/0077793 | A1 * | 3/2009 | Schreiber et al. | 29/622 |
| 2012/0274428 | A1 * | 11/2012 | Reuber et al. | 335/6 |

FOREIGN PATENT DOCUMENTS

| | | | |
|---|---|---|---|
| DE | 10 2007 042041 | B3 | 2/2009 |
| GB | 1 030 798 | A | 5/1966 |
| WO | WO 00/41199 | A1 | 7/2000 |
| WO | WO 03/005389 | A1 | 1/2003 |
| WO | WO 2010/058034 | A1 | 5/2010 |

OTHER PUBLICATIONS

Written Opinion (PCT/ISA/237) issued on Oct. 18, 2011, by the European Patent Office as the International Searching Authority for International Application No. PCT/EP2011/003538.

Search Report issued on Dec. 10, 2010, by the European Patent Office for Application No. 10007321.2.

Search Report issued on Mar. 17, 2011, by the European Patent Office for Application No. 10007321.2.

International Search Report (PCT/ISA/210) issued on Nov. 3, 2011, by the European Patent Office as the International Searching Authority for International Application No. PCT/EP2011/003539.

Written Opinion (PCT/ISA/237) issued on Nov. 3, 2011, by the European Patent Office as the International Searching Authority for International Application No. PCT/EP2011/003539.

Search Report issued on Dec. 10, 2010, by the European Patent Office for Application No. 10007319.6.

Search Report issued on Apr. 1, 2011, by the European Patent Office for Application No. 10007319.6.

* cited by examiner

CIRCUIT-BREAKER POLE PART AND METHOD FOR PRODUCING SUCH A POLE PART

RELATED APPLICATIONS

This application claims priority as a continuation application under 35 U.S.C. §120 to PCT/EP2011/003538, which was filed as an International Application on Jul. 15, 2011 designating the U.S., and which claims priority to European Application 10007321.2 filed in Europe on Jul. 15, 2010. The entire contents of each application is hereby incorporated by reference in its entirety.

FIELD

The disclosure relates to a method for producing a circuit-breaker pole part comprising an external insulating sleeve made of a solid synthetic material for supporting and housing a vacuum interrupter insert for electrical switching a medium-voltage circuit. Furthermore, the present disclosure relates to the circuit-breaker pole part produced by such a method.

BACKGROUND INFORMATION

A circuit-breaker pole part can be integrated in a medium-voltage or high-voltage circuit breaker. Medium-voltage circuit-breakers can be rated between 1 and 72 kV of a high current level. These breakers interrupt the current by generating and extinguishing the arc in a vacuum chamber. Modern vacuum circuit-breakers tend to have a longer life time than former air or oil circuit-breakers. Although vacuum circuit-breakers replaced air or oil circuit-breakers. The present disclosure is not only applicable to vacuum circuit-breakers, but also for air or oil circuit-breakers or modern SF6 circuit-breakers having a chamber filled with sulfur hexafluoride gas instead of vacuum.

For actuating a circuit-breaker, usually a magnetic actuator with high force density is used which moves the electrical contacts of an interrupter insert for a purpose of electrical power interruption. Therefore, a mechanical connection between a movable armature of the magnetic actuator and the moveable contact inside the interrupter insert is provided.

The document DE 10 2004 060 274 A1 discloses a method for producing a circuit-breaker pole part for a medium voltage or high voltage circuit-breaker. A vacuum interrupter is embedded in an insulation material and encapsulated with said material. The vacuum interrupter itself can include an insulator housing which can be cylindrical and is closed at the ends in order to form an inner vacuum chamber. The vacuum chamber contains a fixed electrical contact and a corresponding movable contact for an electrical switch. A folding bellows is arranged on the moveable electrical contact and permits a movement of the respective electrical contact over the current feed line within the vacuum chamber. As mentioned, a high vacuum is maintained within the vacuum interrupter in order to quench as rapid as possible the arc produced during a switching-on or a switching-off action.

Such a vacuum interrupter inside the insulating sleeve can be encapsulated by a synthetic material, mostly plastic material, in order to increase the external dielectric strength of the vacuum interrupter insert. Furthermore, the synthetic material serves as a compensation material for the purpose of compensating for different coefficient of thermal expansion between the vacuum interrupter surface and the surrounding insulating sleeve. This additional function of the intermediate layer avoids possible initiation of cracks.

During the manufacturing process of the circuit-breaker pole part two external electrical contacts are mounted in the insulating sleeve in a first step. In a second step, the pre-mounted interrupter insert is dipped into a liquid rubber solution forming the intermediate layer. In a third step, the external insulating sleeve is produced in a plastic injection-moulding process by the vacuum interrupter insert being encapsulated with plastic material. During encapsulating, the vacuum interrupter insert by moulding under a high process temperature the liquid rubber solution vulcanizes and forms the intermediate compensating layer as described above. For the last production step of vulcanizing a heated moulded form is necessary.

The document U.S. 2008/0142485 A1 discloses another method for producing a pole part of a medium-voltage to high-voltage circuit-breaker arrangement. The external insulating sleeve is produced in a plastic injection-moulding process wherein the vacuum chamber is encapsulated by an injection moulding stop. The insulating sleeve can be produced from plastic or a rubber-elastic material. Prior to the plastic embedding of the vacuum-interrupter, it can be encased by an intermediate compensating layer. In order to achieve good adhesion properties, an additional bonding agent can be used. During manufacturing the compensating layer is firstly applied to the vacuum interrupter, which is in further step encapsulated by injection moulding with plastic material and then is provided with further layers of plastic material. A respective number of different injection moulding forms can be specified in order to achieve the multi-layer design.

Without an additional bonding agent a reliable bonding between the different layers is not possible.

SUMMARY

An exemplary method for producing a circuit-breaker pole part having an external insulating sleeve made of a solid synthetic material for supporting and housing a vacuum interrupter for electrical switching a medium-voltage circuit is disclosed, the method comprising: applying an adhesive material layer at least on a lateral area of the interrupter as a coating; and molding the coated interrupter with the solid synthetic material in order to embed the coated interrupter into the solid synthetic material thereby forming a single layer of the surrounding external insulating sleeve.

An exemplary circuit-breaker pole part is disclosed comprising: an external insulating sleeve made of a solid synthetic material for supporting and housing a vacuum interrupter for electrical switching a medium-voltage circuit; and an adhesive material layer that coats at least a lateral area of the interrupter, wherein the coated interrupter is embedded in the solid synthetic material of the external insulating sleeve, and wherein a thickness of the adhesive material is selected from a range of 0.5 to 5 millimeters that provides mechanical stress compensation and reliable fixation.

DETAILED DESCRIPTION

Figure 1:
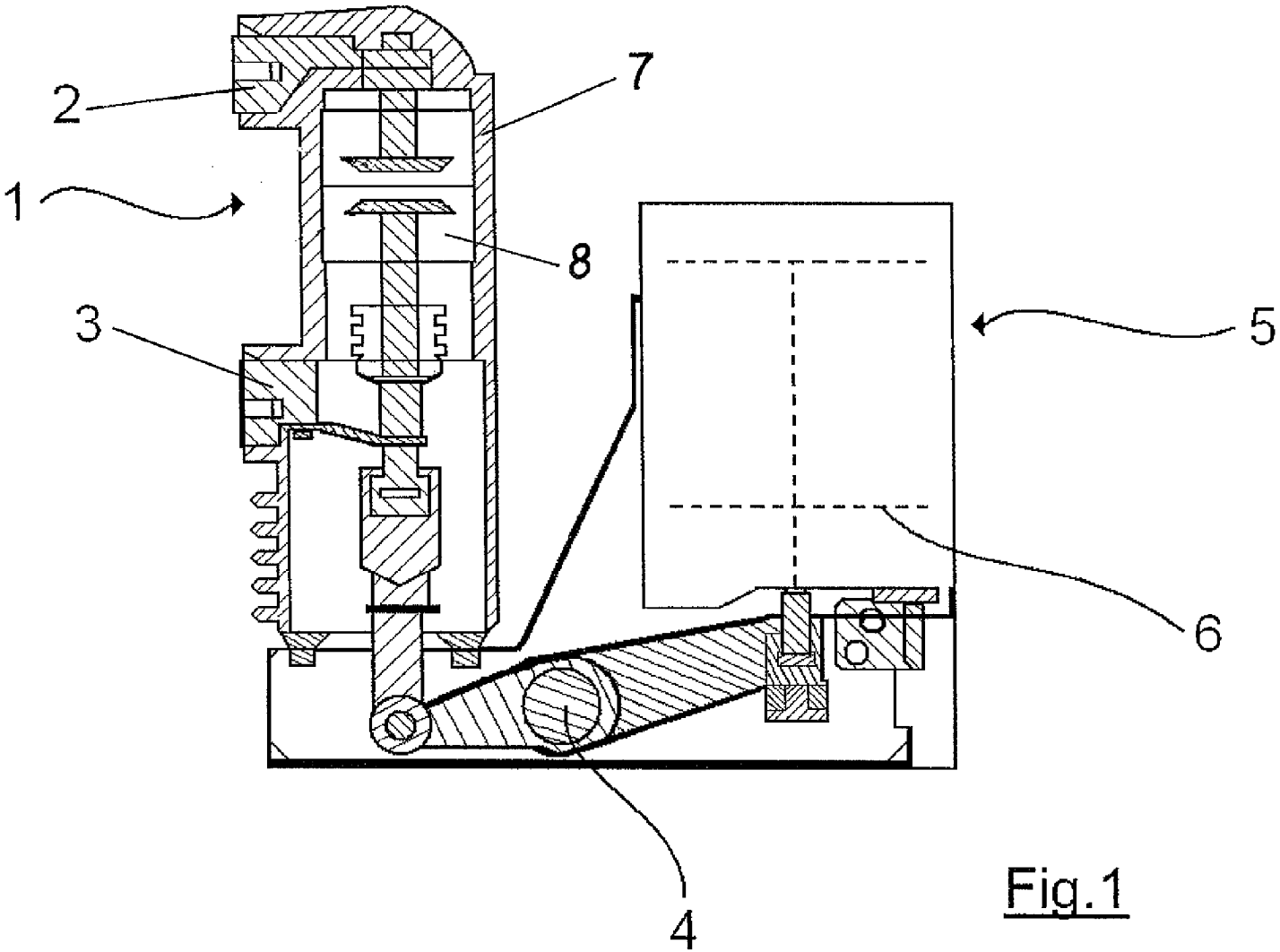
FIG. 1 is a schematic side view of a medium-voltage circuit-breaker operated by a magnetic actuator in accordance with an exemplary embodiment of the present disclosure.

Exemplary embodiments of the present disclosure provide a method for efficiently producing a pole part for a circuit-breaker having an intermediate compensation layer that can provide a reliable bond between the vacuum interrupter insert and the surrounding insulating material.

According to an exemplary embodiment of the disclosure a method for producing a circuit-breaker pole part comprises an external insulating sleeve made of a solid synthetic material for supporting and housing an inner vacuum interrupter insert for electrical switching a medium-voltage circuit, including the following production steps:

Applying an adhesive material layer at least on the lateral area of the interrupter insert.

Embedding the coated interrupter insert by injection moulding with the solid synthetic material in order to form a single layer of the surrounding external insulating sleeve.

The special intermediate material layer combines the function of mechanical compensation and the function of an adhesive property in order to provide a reliable bond between the vacuum interrupter insert and the surrounding insulating material of the external insulating sleeve which can consist of different insulating materials, e.g. the epoxy material thermal plastic material; silicon rubber material. According to an exemplary embodiment of the present disclosure, for the intermediate layer a special material is chosen with has mechanical compensating function and also adhesive property function for embedding vacuum interrupter inserts in material for forming the surrounding insulating sleeve, in order to provide a certain bonding between said parts. The special adhesive material layer according to the present disclosure could be used for a temperature over at least 115° C. and could withstand −40° C. It provides bonding for life over many years and has suitable dielectric insulation properties.

Thus, the solution according to an exemplary embodiment of the present disclosure can achieve better mechanical properties and better dielectric properties compared to prior art solutions.

In other exemplary embodiments, special production processes could be used to add the adhesive material layer on the other surface of the vacuum interrupter insert. According to a first exemplary process the adhesive material layer is applied on the interrupter insert by taping or bonding of a solid adhesive material. A suitable solid adhesive material can be selected from a group, including (e.g., comprising) a double side adhesive tape, a heatable taping bend or the like.

According to another exemplary method of the present disclosure, the adhesive material layer could also be applied on the other surface of the interrupter insert by spraying, coating or dipping in a liquid adhesive material. A suitable liquid adhesive material is selected from a group including (e.g., comprising) spray-on glue, liquid glue or the like.

According to another exemplary embodiment of the present disclosure, the thickness of the applied adhesive material layer should be big enough in order to achieve sufficient mechanical stress compensation. In an exemplary embodiment disclosed herein, the foregoing described special material has an optimum thickness in the range of between 0 to 5 mm.

For embedding vacuum interrupter inserts in epoxy material, cold and hop shrinkage tube or Si rubber could be used. These materials can provide very good mechanical compensation between the vacuum interrupter insert and in order to improve a material as chosen which provide the same mechanical compensation and has extra adhesive property to get the epoxy material bonded to the vacuum interrupter insert. For example, acrylate double side adhesive film with a thickness of up to 5 mm could be used for the intermediate material layer.

For embedding vacuum interrupter inserts in thermal plastic material, no compensation and adhesive material has been used so far. A suitable compensation material which has the adhesive property according to exemplary embodiments described herein can be an acrylate double side adhesive film, a hot melts film, acryldispersive adhesive, co-polyamide, polyerfine, polyamid, polyester, hot melts. Based on conditions, an additional primer film could be chosen for a better bonding effect.

For embedding vacuum interrupter inserts in a silicon rubber material or other soft insulating materials, e. g. soft epoxy or PUR (polyurethane), usually an additional primer is used to have a better bonding effect. Instead of an additional primer film, an adhesive layer, like acrylate double side adhesive films could be used for bonding the silicon rubber or other soft insulating material with the outer surface of the vacuum interrupter insert.

The foregoing and other aspects of the disclosure will become apparent following the detailed description of the disclosure, when considered in conjunction with the enclosed drawings.

FIG. 1 is a schematic side view of a medium-voltage circuit-breaker operated by a magnetic actuator in accordance with an exemplary embodiment of the present disclosure. The medium-voltage circuit breaker shown in FIG. 1 can principally consists of at least a pole part 1 with an upper electrical terminal 2 and a lower electrical terminal 3 for electrical switching a medium voltage circuit. Therefore, the lower electrical terminal 3 is connected to an electrical contact which is moveable between the closed and the opened position via a jackshaft 4. This jackshaft 4 internally couples the mechanical energy of a bistable magnet actuator 5 to the pole part 1.

The magnetic actuator 5 can consist of a bistable magnetic arrangement for switching of an armature 6 to the relative position are effected by magnetic fields generated by an—not shown—electrical magnet and permanent magnet arrangement, which could have single or multiple coils.

The pole part 1 comprises an external insulating sleeve 7 as a housing which is made of a solid synthetic material, e. g. epoxy material, thermal plastic materials. The insulating sleeve 7 supports and houses a vacuum interrupter insert 8 having two corresponding electrical contacts which are switchable under vacuum atmosphere. Said electrical contacts of the vacuum interrupter 8 are electrically connected to the upper electrical terminal 2 and the lower electrical terminal 3 respectively.

Figure 2:
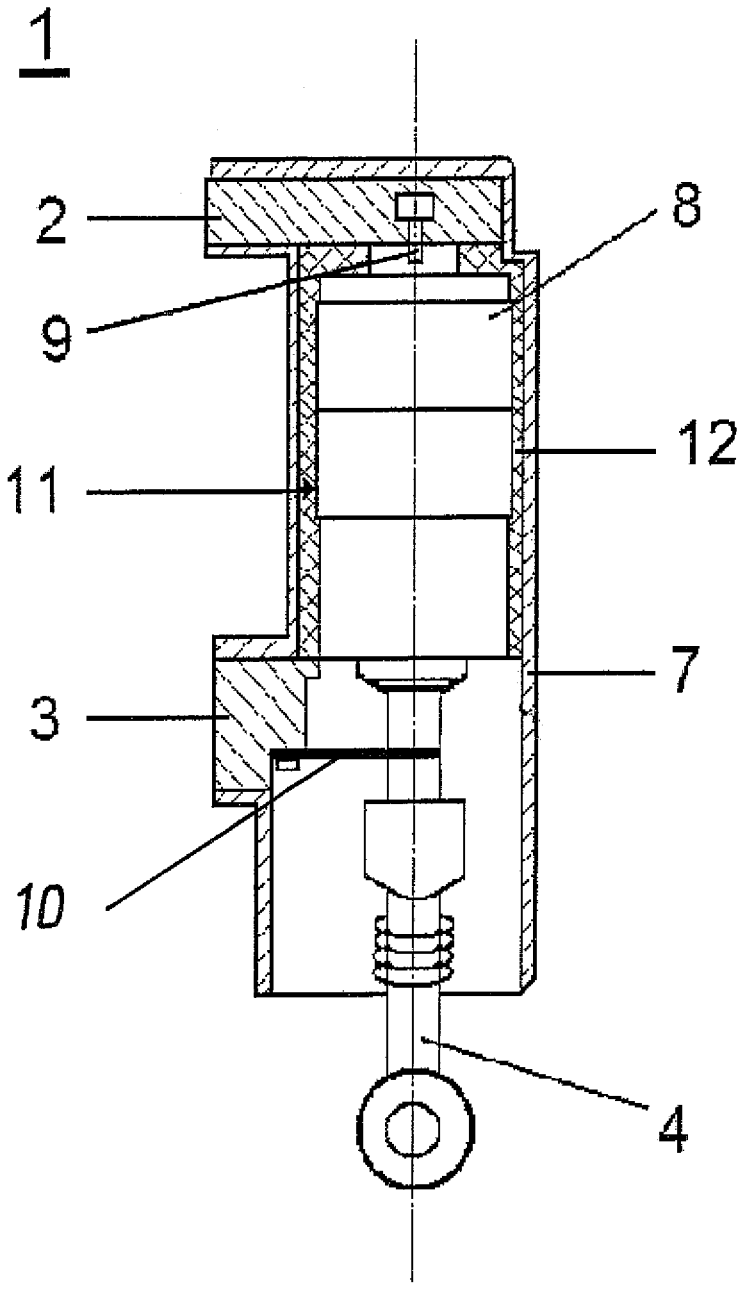
FIG. 2 is a schematic axial section of the arrangement of FIG. 1 in accordance with an exemplary embodiment of the present disclosure.

FIG. 2 is a schematic axial section of the arrangement of FIG. 1 in accordance with an exemplary embodiment of the present disclosure. As shown in FIG. 2, the pole part 1 of the foregoing described circuit-breaker further comprises a threaded bold 9 on the upper electrical terminal 2 for fastening the interrupter insert 8 on the upper electrical terminal 2. At the same time, the electrical connection is provided.

For electrical connecting the lower electrical terminal 3 with the corresponding electrical contact of the interrupter insert 8 and intermediate flexible connector 10 is provided in order to achieve an axial movement of the lower electrical connection. On the distal end of said electrical contact, the jackshaft 4 is arranged for said operating function.

The geometrical relation between the insulating sleeve 7 and the inner vacuum interrupter 8 is designed in a way that on the lateral area 11 of the interrupter 8 an adhesive material layer 12 is provided. The adhesive material layer 12 is applied on the interrupter insert 8 by taping with a solid adhesive material, e. g. a double side adhesive tape. The additional adhesive material layer 12 between the external insulating sleeve 7 and the inner vacuum interrupter insert 8 compensates mechanical stress and serves as a reliable fixation additionally. After applying the adhesive material layer 12 on the outer surface of the interrupter 8 the interrupter 8 will be embedded by moulding with epoxy or thermal plastic material.

The disclosure is not limited by the exemplary embodiments described above which is presented as an example only but can be modified in various ways within the scope of protection defined by the following patent claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 Pole part
2 upper electrical terminal
3 lower electrical terminal
4 jackshaft
5 magnetic actuator
6 armature
7 insulating sleeve
8 vacuum interrupter insert
9 threaded bold
10 flexible connector
11 a lateral area
12 adhesive material layer

What is claimed is:

1. A circuit-breaker pole part comprising:

an external insulating sleeve made of a solid synthetic material for supporting and housing a vacuum interrupter for electrical switching a medium-voltage circuit; and an adhesive material layer that coats at least a lateral area of the interrupter, wherein the coated interrupter is embedded in the solid synthetic material of the external insulating sleeve, wherein a thickness of the adhesive material is selected from a range of 0.5 to 5 millimeters that provides mechanical stress compensation and reliable fixation, and wherein a solid adhesive material of the adhesive material layer is selected from a group, comprising: a double side adhesive tape, and a heatable taping band.

2. The circuit-breaker pole part according to claim 1, comprising:

a threaded bolt molded on an upper electrical terminal of a top portion of the insulation sleeve, wherein the interrupter is an insert that is frontal screwed on the threaded bolt of the insulation sleeve to provide a fixed upper electrical connection.

3. The circuit-breaker pole part according to claim 1, wherein the interrupter is electrically connected to a lower electrical terminal molded in a side wall of the insulation sleeve via an intermediate flexible connector to provide an axial movable lower electrical connection.

4. The circuit-breaker pole part according to claim 1, comprising:

a pole; and a magnetic actuator mounted under the pole.

5. The circuit-breaker pole part according to claim 1, wherein an angle between an axis of an upper and lower terminal and a main axis of the vacuum interrupter is between 0° and 180°.

6. A circuit-breaker pole part, comprising:

an external insulating sleeve made of a solid synthetic material for supporting and housing a vacuum interrupter for electrical switching a medium-voltage circuit; and an adhesive material layer that coats at least a lateral area of the interrupter, wherein the coated interrupter is embedded in the solid synthetic material of the external insulating sleeve, wherein a thickness of the adhesive material is selected from a range of 0.5 to 5 millimeters that provides mechanical stress compensation and reliable fixation, and wherein a liquid adhesive material of the adhesive material layer is selected from a group, comprising: spray-on glue, and liquid glue.

7. The circuit-breaker pole part according to claim 6, wherein an angle between an axis of an upper and lower terminal and a main axis of the vacuum interrupter is between 0° and 180°.

8. A circuit-breaker pole part, comprising:

an external insulating sleeve made of a solid synthetic material for supporting and housing a vacuum interrupter for electrical switching a medium-voltage circuit; and an adhesive material layer that coats at least a lateral area of the interrupter, wherein the coated interrupter is embedded in the solid synthetic material of the external insulating sleeve, wherein a thickness of the adhesive material is selected from a range of 0.5 to 5 millimeters that provides mechanical stress compensation and reliable fixation, and wherein a solid synthetic insulating material of the insulating sleeve is selected from a group comprising: epoxy material, thermal plastic material, silicon rubber material, and silicon gel material.

9. The circuit-breaker pole part according to claim 8, wherein the insulating sleeve includes epoxy material and the adhesive material layer includes an acrylate double side adhesive film.

10. The circuit-breaker pole part according to claim 8, wherein the insulating sleeve includes thermal plastic material and the adhesive material layer includes one of an acrylate double side adhesive film, a hot melts film, an acryl dispersive adhesive, co-polyamide hot melts, a polyamid, a polyefin, and a polyester.

11. The circuit-breaker pole part according to claim 8, wherein the insulating sleeve includes a silicon rubber material and the adhesive material layer includes an acrylate double side adhesive film.

12. The circuit-breaker pole part according to claim 10, wherein the vacuum interrupter is molded with an external layer of a hot melts layer by low pressure molding process between 0 and 200 bars, and a layer of a stable insulation layer, which is used as one component separately.

13. The circuit-breaker pole part according to claim 12, wherein through a low pressure moulding process the hot-melts are molded between the vacuum interrupter and an external shell, which acts as a mold and insulation material, to form electrical insulation.

14. The circuit-breaker pole part according to claim 8, wherein an angle between an axis of an upper and lower terminal and a main axis of the vacuum interrupter is between 0° and 180°.

* * * * *